US005305950A

United States Patent [19]

Oppenheim

[11] Patent Number: 5,305,950

[45] Date of Patent: Apr. 26, 1994

[54] LOCK FOR CARTON BOTTOM

[75] Inventor: Paul J. Oppenheim, San Jose, Calif.

[73] Assignee: International Paper Company, Purchase, N.Y.

[21] Appl. No.: 48,171

[22] Filed: Apr. 20, 1993

[51] Int. Cl.[5] ..... B65D 5/10

[52] U.S. Cl. ..... 229/157; 229/185

[58] Field of Search ..... 229/156, 157, 185

[56] References Cited

U.S. PATENT DOCUMENTS

| | | | |
|---|---|---|---|
| 634,646 | 10/1899 | Knobeloch | 229/157 |
| 1,997,667 | 4/1935 | Woerner . | |
| 2,053,857 | 9/1936 | Weiss | 229/157 |
| 2,151,733 | 3/1939 | Bonfield | 229/156 |
| 2,336,655 | 12/1943 | Tobey et al. . | |
| 2,337,198 | 12/1943 | Holy . | |
| 2,339,224 | 1/1944 | Shina . | |
| 2,361,603 | 10/1944 | Cohen et al. | 229/157 |
| 2,426,484 | 8/1947 | Buffenbarger . | |
| 2,983,420 | 5/1961 | Rellstab . | |
| 3,194,480 | 7/1965 | Maindron . | |
| 4,821,949 | 4/1989 | Booth . | |
| 5,022,582 | 6/1991 | Ritter . | |
| 5,046,662 | 9/1991 | Cowles | 229/185 |
| 5,104,035 | 4/1992 | Rosenbaum . | |
| 5,139,196 | 8/1992 | Fry et al. | 229/157 |

FOREIGN PATENT DOCUMENTS 21842 11/1961 Austria .

*Primary Examiner*—Gary E. Elkins
*Attorney, Agent, or Firm*—Michael J. Doyle

[57] ABSTRACT

A carton, typically of corrugated paperboard, is formed from a one-piece blank having major side wall bottom flaps and minor end wall bottom flaps arranged to be securely interlocked, for which purpose openings which comprise or include slits are provided preferably in the major side wall bottom flaps into which may be inserted tabs preferably on the corners of the minor end wall bottom flaps. The tabs are shaped so as to provide hooks which engage exposed edges of the slits to lock and prevent the tabs from being accidentally withdrawn after insertion, thus providing a carton with a locked bottom closure.

6 Claims, 2 Drawing Sheets

LOCK FOR CARTON BOTTOM

BACKGROUND OF THE INVENTION

In the fruit growing industry, particularly that which involves the production of relatively heavy fruit items such as melons, grapefruit and cantaloupe, there is a continuing need for a paperboard carton or container which has a bottom which may be formed from the flap parts of the carton blank with the flap parts interrelated in such a way that they may be quickly and securely locked together in the usual container hand-forming process without gluing, stapling, or other extraneous mechanical means.

For this purpose there have been developed various forms of carton parts including side wall and end wall bottom flaps which have various forms of tabs which can be inserted into openings in related flaps which are arranged to receive them. Examples are afforded by U.S. Pat. No. 5,104,035 issued to Booth and Austrian Patent 218,420 issued in 1961 to Stoklasek. But nothing has been done adequately to interlock the flaps and their respective tabs in place relative to each other by means provided solely by the shapes of the various parts and without the need or use of extraneous fastening means.

Accordingly the primary object of this invention is to provide a one-piece carton blank formed and arranged in such manner that when the blank is assembled into a carton the bottom parts may be easily brought together and securely locked so that accidental withdrawal and disassembly is prevented in spite of any weight of the contents or rough handling of the cartons in transportation and use and so that any intended disassembly can only be accomplished by careful manipulation of the parts.

SUMMARY OF THE INVENTION

A one-piece blank for forming a carton or container usually of corrugated paperboard has alternately end wall and side wall portions terminating in a glue flap on one end which can be attached to the other end of the blank to form a rectangular-shaped tube which can be collapsed to a flat condition for shipment to the carton customer. The side wall portions have a pair of bottom closure flaps, termed major flaps, connected to them by hinge connections. In the preferred embodiment each such bottom is or extends as a slit, preferably normal to the side wall hinge connection of the flap. The openings shown have open expanses of removed material.

The end wall portions of the blank have another pair of bottom closure flaps, termed minor flaps, attached by hinged connections. These other flaps have outer corner locking tabs arranged so that, during erection of the carton, they may be inserted into corresponding said openings major flaps shaped to form hooks engageable with edges of the slits exposed inwardly of the carton by displacement of the said split edges by insertion of the locking tabs into the slits so as to prevent accidental retraction of the tabs from the openings.

With this configuration, the locking tabs will remain in place even if the hooks jump off the slit edges because they will then lock themselves against inside surfaces of the major bottom closure flaps adjacent the slits.

Since the essential feature of the invention is the provision of hook-like portions on one pair of bottom or minor closure flaps which will impinge against inwardly displaced slit edges on the other pair of bottom or major closure flaps to prevent accidental withdrawal from the slits, the configuration and locations of the openings and of the locking flaps and their parts may be varied with respect to each other for this purpose within the scope of the invention.

DETAILED DESCRIPTION OF THE INVENTION

Figure 1:
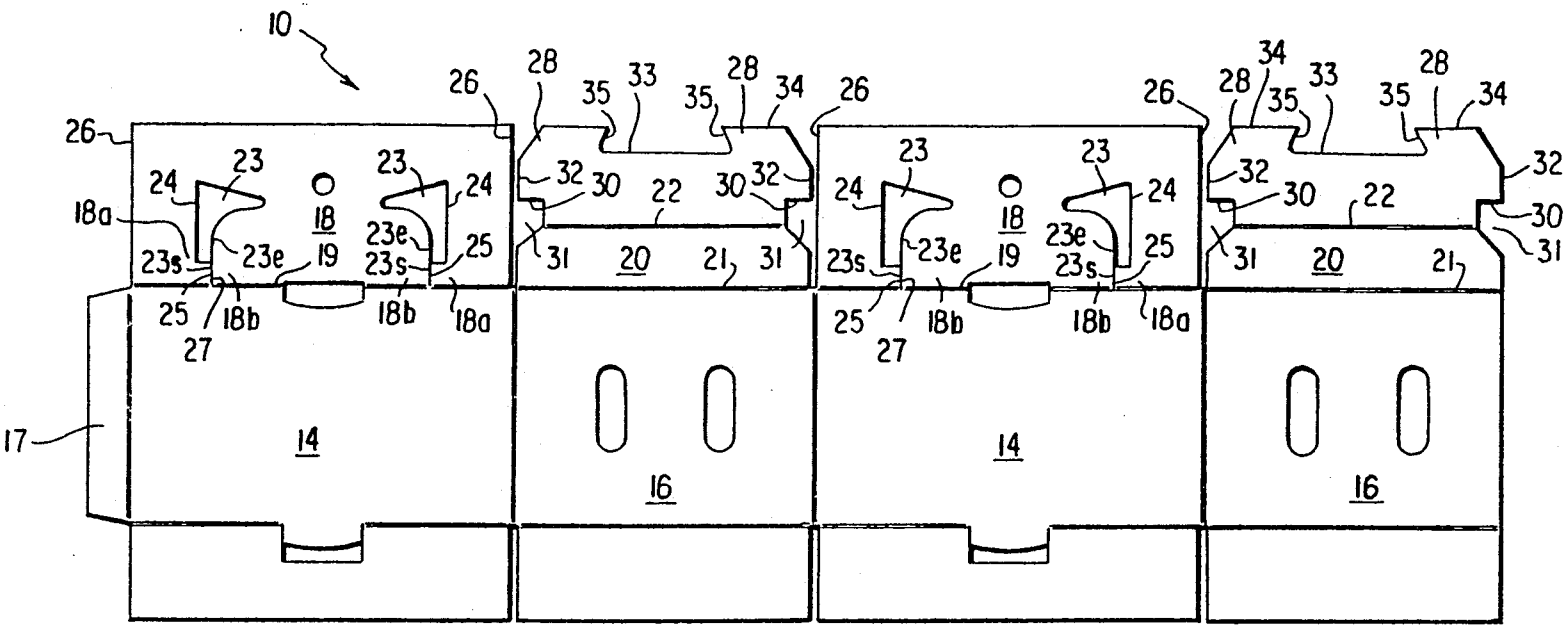
FIG. 1 is a plan view of a preferred embodiment of a one-piece corrugated paperboard blank of the invention.
Figure 2:
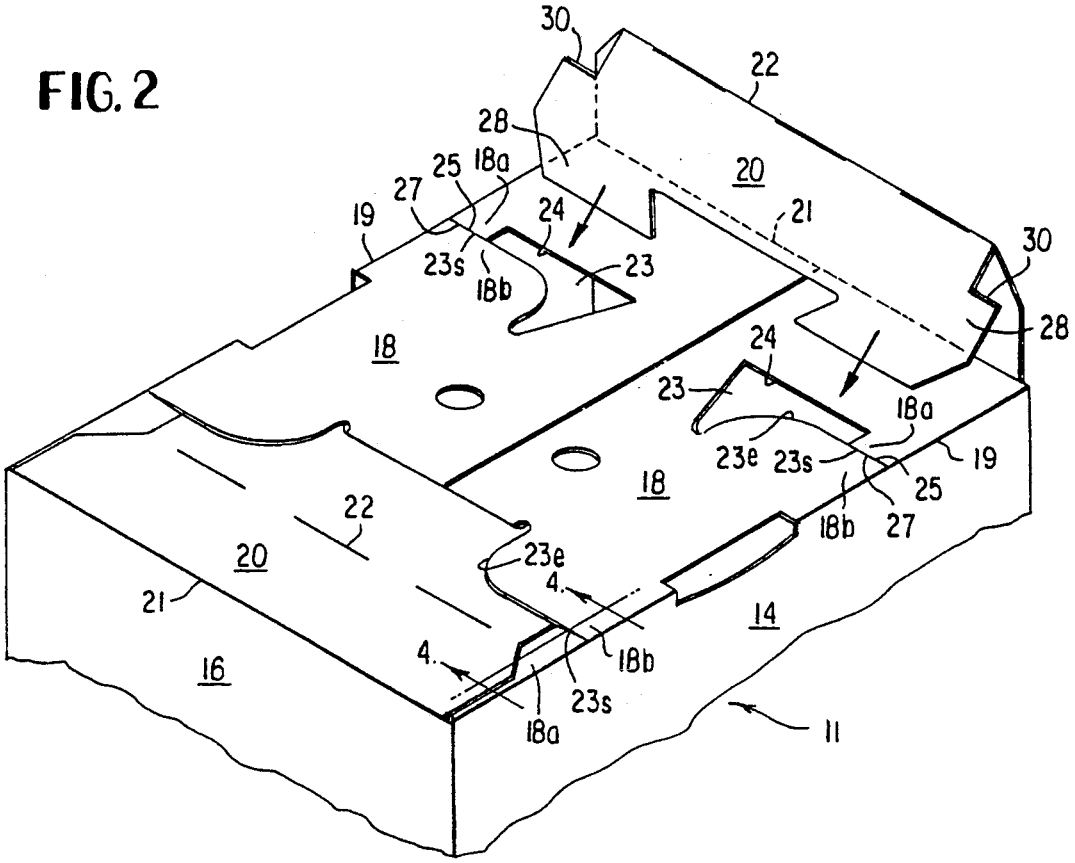
FIG. 2 is an upside-down partial perspective view of a carton being formed from the blank of the invention showing locking tabs on a minor bottom closure flap being inserted in corresponding openings, in the major bottom flaps, as indicated by the arrows on one end of the box and the said tabs on the opposite end of the box (nearest the reader) already in place.
Figure 3:
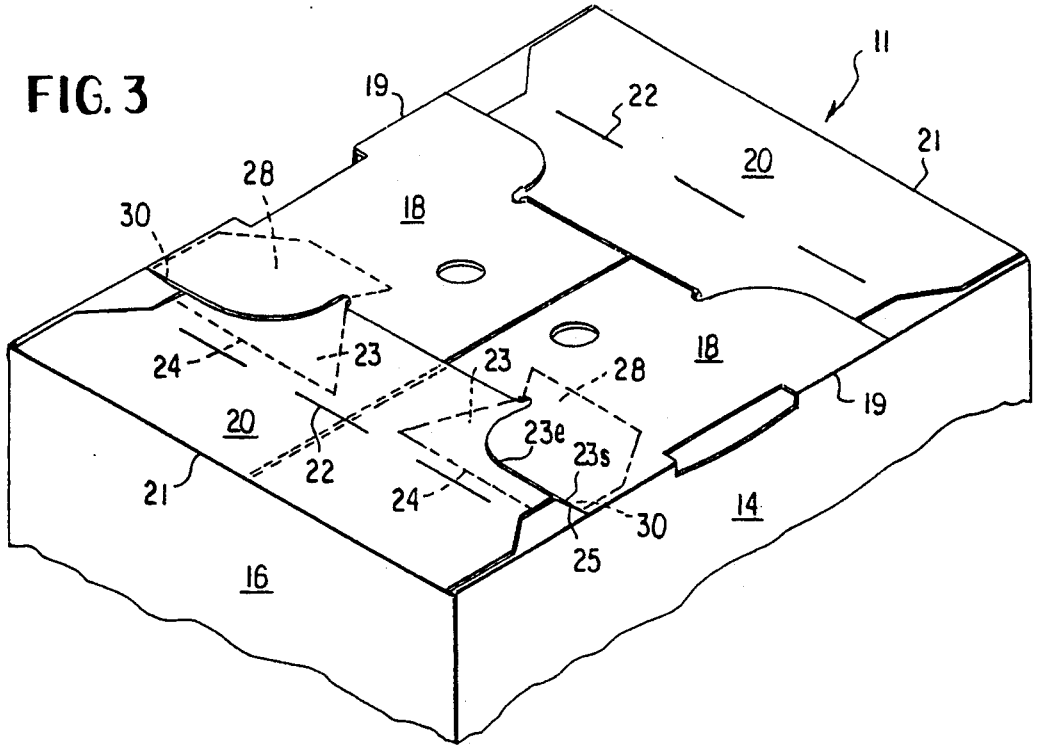
FIG. 3 is a view similar to that of FIG. 2 showing the parts of the bottom of the box already locked in place, ready for use.

A preferred embodiment of the blank of the invention is indicated at 10 in FIG. 1, and the essential parts of the carton formed from the blank of the invention are indicated as 11 as upside-down views which show the bottom of the carton being formed in FIGS. 2 and 3.

The blank 10 as best seen in FIG. 1 has alternatively connected side wall portions 14 and end wall portions 16 terminating in a glue flap 17. The side wall portions 14 have major bottom closure flaps 18 attached to them by side wall hinge connections 19. The end wall portions 16 have minor bottom closure flaps 20 attached to them by end wall hinge connections 21.

Each of the major bottom closure flaps 18 has a pair of openings 23. The L-shaped form of these openings shown with an open expanse of removed material has an edge **23*e* extending as one edge 23*e* of a slit 23*s*. The slits 23*s* extend outwardly preferably to the adjacent side wall hinge connections 19. The openings 23 have straight edges 24 generally perpendicular to the hinge connections 21 of the minor flaps 20 in the erected carton 11**. The openings are thus shaped to provide clearance and thus convenience in assembly of the parts.

The minor bottom closure flaps 20 have outer corner locking tabs 28 which are arranged and shaped to be readily introduced and inserted into corresponding major flap openings 23 and slits **23*s* while the carton is being formed, as best seen in the upper right-hand end of the carton configuration shown in FIG. 2. Each tab 28 is shaped to form a hook 30 engageable with an edge 25 of a slit 23*s* which is exposed inwardly, i.e., downwardly as seen in FIGS. 2 and 3, by displacement of the slit edges 25 by insertion of the locking tab 28 into the openings 23 and associated slit 23*s*, seen in detail in FIG. 4** and further described.

As best seen in FIGS. 1 and 2, each hook 30 is formed as the outer end of an aperture 31 on a side edge 32 of each minor flap 20. The edge of the hook 30 is preferably arranged to be substantially parallel to a slit **23*s* with which it is engaged in erection of the carton. The locking tabs 28 may also each be partially formed by an aperture 33 in the outer end edge 34 of each minor closure flap and shaped to provide an additional hook portion 35 on the inner edge of tabs 28**.

Each of the minor flaps 28 preferably has a secondary fold line 22 extending across it so that it may more easily be bent temporarily to facilitate insertion of the tabs 28 into their corresponding openings 23, as best seen in FIG. 2.

Figure 4:
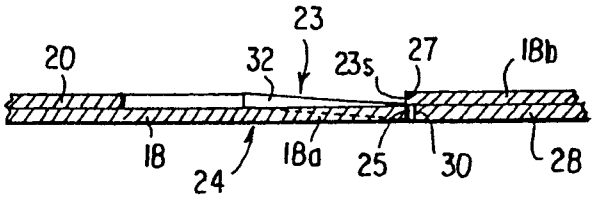
FIG. 4 is a partial cross-section view taken along the line 4—4 in FIG. 2 showing in detail part of a minor bottom flap locking tab inserted in an opening in a major side wall bottom closure flap.

Referring to the partial sectional view of FIG. 4, it will be seen that when a tab 28 is being inserted into an opening 23 and its outwardly extending slit 23*s* as is about to be deformed as shown in the upper right hand end of the partially erected carton of FIG. 2 with its major flaps 18 in final erected portions, a portion 18*a* of the major flap 18 adjacent the slit 23*s* with the slit edge 25 is displaced permanently downwardly and inwardly of carton 11 relative to the major flap portion 18*b* and the other slit edge 27 to thereby allow entry of each tab 28 and hook 30 through the slit 23*s*. This leaves a downwardly or inwardly exposed slit edge 25 which is engaged by the hook 30 in tab 28 preventing its withdrawal in ordinary use of the carton and extremely difficult even by skillful manipulation. And should the parts be disturbed from this relationship with each other so that the hook 30 slips off the slit edge 25, the hook 30 will still be engaged against an inside part of the flap 28 near the slit 23*s*, that is, underneath the carton bottom as viewed in FIGS. 2 and 3, thereby maintaining a securely locked carton bottom.

Thus it will be seen that, while the practice of inserting tabs on bottom parts of cartons into openings in corresponding parts has been quite usual, there has been no adequate provision until the disclosure of this invention for adequately retaining the parts in place under the weight and pressure of the contents of the container and that only as herein described and claimed has such improvement become available.

I claim:

1. A paperboard container formed from a unitary paperboard blank, the container having sides which are defined by two length panels and two width panels, each of said panels having an upper and a lower edge and being generally rectangular, major bottom panels foldably secured along straight hinge connections to said lower edges of respective said length panels, minor bottom panels foldably secured along straight hinge connections to said lower edges of respective of said width panels, said bottom panels forming a bottom for the container, each of said bottom panels being interlocked with two next adjacent said bottom panels, said two major bottom panels being substantially coplanar, each of said major bottom panels having a pair of spaced openings, each of said major bottom panel openings spaced from respective major bottom panel straight hinge lines, each of said minor bottom panels having free ends, said free ends provided with outer corner locking tabs, said locking tabs engaged in respective said major bottom panel openings, at least a part of each of said major bottom panel openings intersected by a respective slit which extends substantially normal to and adjacent to a respective said major bottom panel hinge connection, each of said minor bottom flap outer corners locking tabs forming a hook engaged with a respective edge of one of said slits exposed by displacement of said slit edges upon insertion of said locking tabs into respective said major flap openings thereby preventing accidental retraction of said tabs from said major flap openings.

2. The container of claim 1 wherein said major flap openings are substantially L-shaped.

3. The container of claim 1 in which said minor bottom closure flaps also have secondary fold likes extending across them to facilitate insertion of said respective tabs into corresponding said major flap openings, said secondary fold lines being substantially parallel to said minor bottom flap straight hinge connections.

4. A blank for forming a carton with a locked bottom closure, said blank having side wall and end wall body portions and including:

(a) a first pair of major bottom closure flaps attached by straight hinge connections to a first pair of said body portions, (b) a second pair of minor bottom closure flaps attached by straight hinge connections to a second pair of said body portions, (c) a pair of openings in each of said major bottom closure flaps at least parts of said openings intersected by slits, each of said slits extending substantially normal to and adjacent to a respective said straight hinge connection (d) said minor bottom closure flaps having outer corner locking tabs shaped to be inserted into corresponding openings in said major flap and to form hooks engageable with respective edges of said slits exposed by displacement of said slit edges by insertion of said locking tabs into said major flap openings thereby preventing accidental retraction of said tabs from said openings in said major flaps.

5. A blank as set forth in claim 4 in which said major flap openings are substantially L-shaped with open expanses of removed material.

6. The blank of claim 4 in which said minor bottom closure flaps also have secondary fold lines extending across them to facilitate insertion of said respective tabs into corresponding said major flap openings, said secondary fold lines being substantially parallel to said minor bottom flap straight hinge connections.

* * * * *